US006994679B1

(12) United States Patent
Lee

(10) Patent No.: US 6,994,679 B1
(45) Date of Patent: Feb. 7, 2006

(54) MESSAGE DEVICE

(76) Inventor: Kun-Ta Lee, 235 P.O. Box 8-24 Chung-Ho, Taipei (TW)

( * ) Notice: Subject to any disclaimer, the term of this patent is extended or adjusted under 35 U.S.C. 154(b) by 0 days.

(21) Appl. No.: 11/054,138

(22) Filed: Feb. 10, 2005

(51) Int. Cl.
*A61H 7/00* (2006.01)

(52) U.S. Cl. ..... 601/15; 601/20

(58) Field of Classification Search ..... 601/15, 601/20, 21
See application file for complete search history.

(56) References Cited

U.S. PATENT DOCUMENTS 4,805,972 A * 2/1989 Tanaka et al. ..... 359/200
5,318,071 A * 6/1994 Gaiardo ..... 137/625.65
RE34,663 E * 7/1994 Seale ..... 600/587
6,617,739 B1 * 9/2003 Kinoshita ..... 310/198
6,914,504 B2 * 7/2005 Kajino et al. ..... 335/126

* cited by examiner

*Primary Examiner*—Michael A. Brown

(57) ABSTRACT

A massage device capable of producing vibrating or reciprocating motions for massaging muscles of a person comprises a shell, enclosed at the upper and lower end by a pair of end plates, houses a coaxial central axle provided with a middle voice coil having a plurality of brushes. The brushes are each slidably mounted on a longitudinal electric brush axle through an insulting sleeve The inner wall of the shell is provided by upper, middle and lower sets of magnets, whereby an electric current flowing into the electric brush axles and the coils mounted thereon will produces a magnetic field interacting with the field by the magnets, urging the central axle to move in the longitudinal direction. Since the current is alternating, the associated motion of central axle is reciprocating, ready for the purpose of massage.

1 Claim, 4 Drawing Sheets

MESSAGE DEVICE

FIELD OF THE INVENTION

The present invention relates to massage device, moiré particularly to a massage device capable of producing vibrating or reciprocating motions for massaging muscles of a person.

BACKGROUND OF THE INVENTION

The massage devices of the prior art mainly comprise a massage head and a stick body housing an actuating device. The conventional massage devices have the disadvantages as follows.

a. The massage head produces vibrations of mild amplitudes.
b. The frequency of the vibration is fixed.
c. The massage head cannot do substantial reciprocating motions along the longitudinal direction.
d. The vibration of the massage head is driven mechanically and the mechanism could wear out after a limited period of time.
e. Therefore, the maintenance cost is high.

Therefore, inventing a massage device capable of doing substantial reciprocating motions and having better durability is significant.

SUMMARY OF THE INVENTION

The primary objective of the present invention is to provide a massage device capable of producing vibrating or reciprocating motions for massaging muscles of a person.

The various objects and advantages of the present invention will be more readily understood from the following detailed description when read in conjunction with the appended drawings.

DETAILED DESCRIPTION OF A PREFERRED EMBODIMENT

Figure 1:
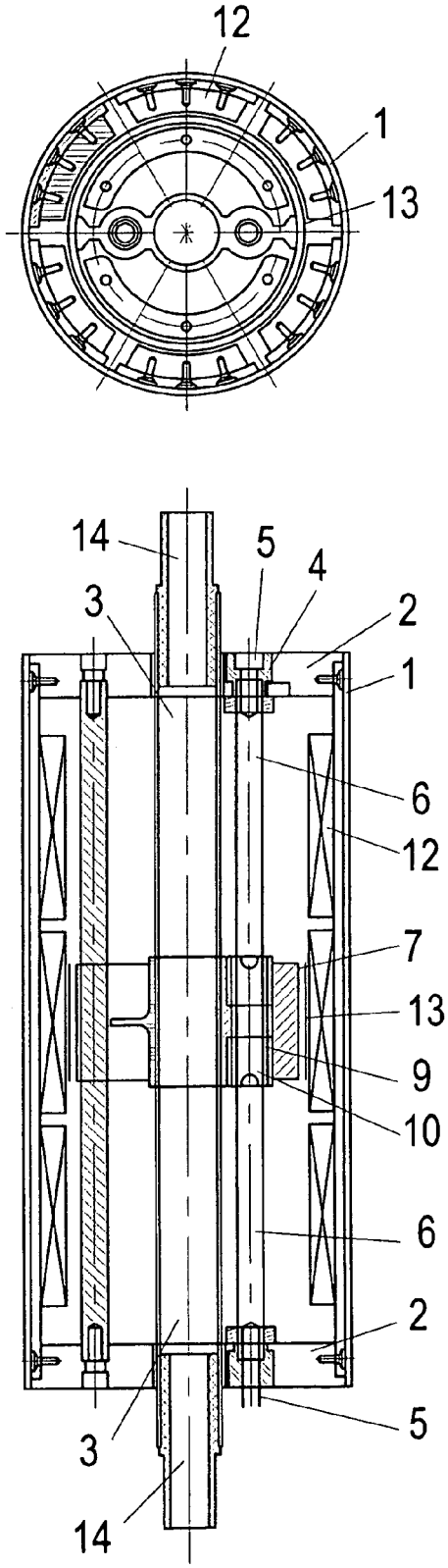
FIG. 1 shows a lateral cross section and a top cross section of a massage device of the present invention.
Figure 2:
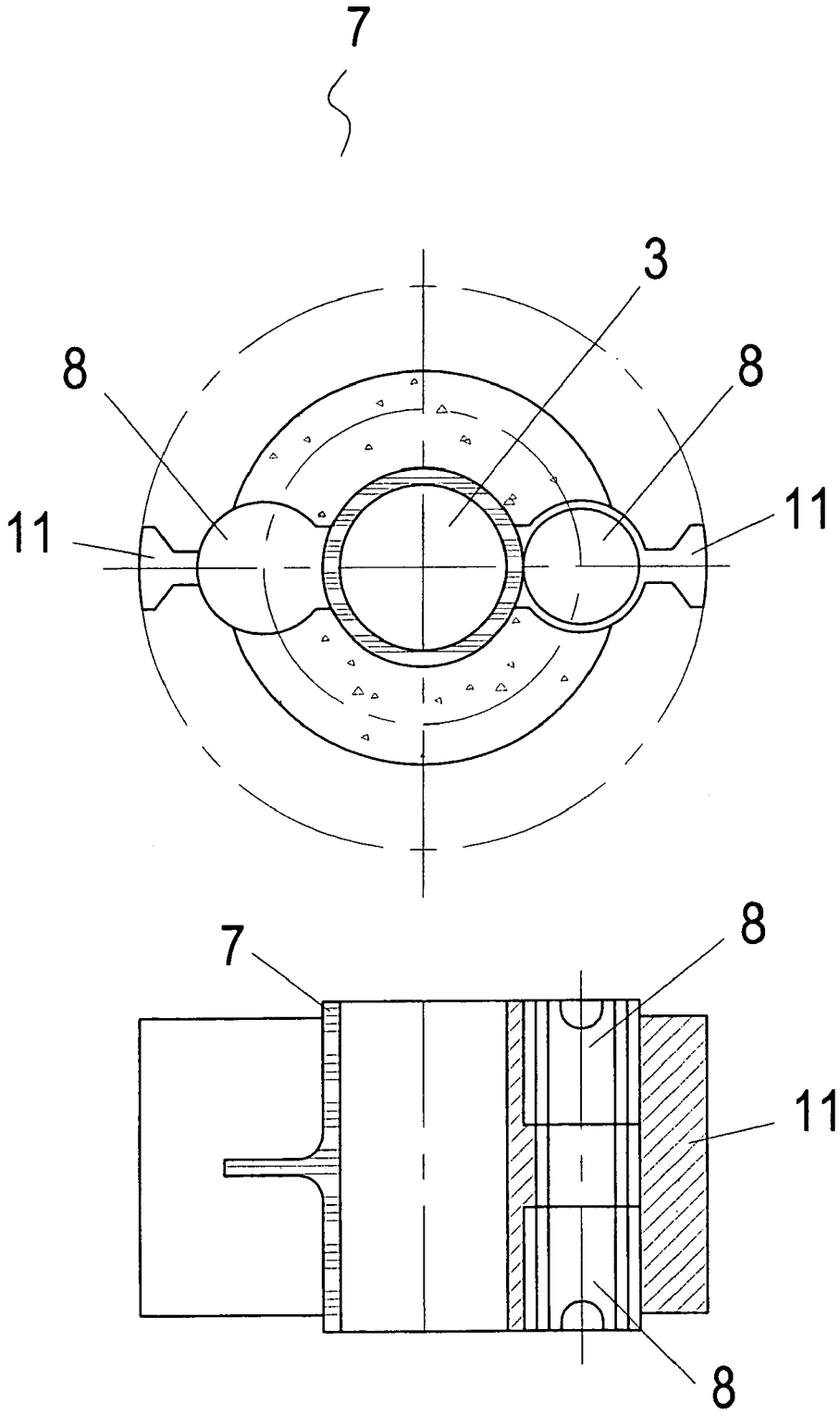
FIG. 2 is a top cross sectional view of the voice coil of the massage device in FIG. 1.
Figure 3:
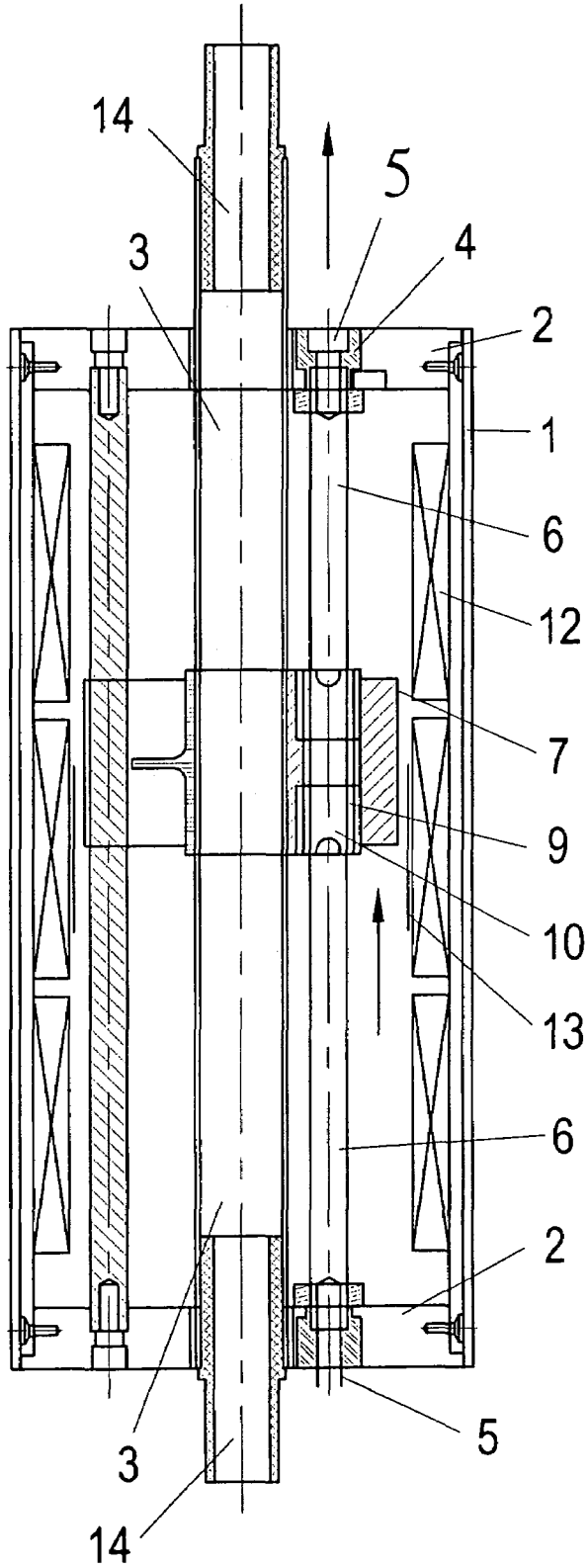
FIG. 3 illustrates the internal configuration of the massage device moving upward.
Figure 4:
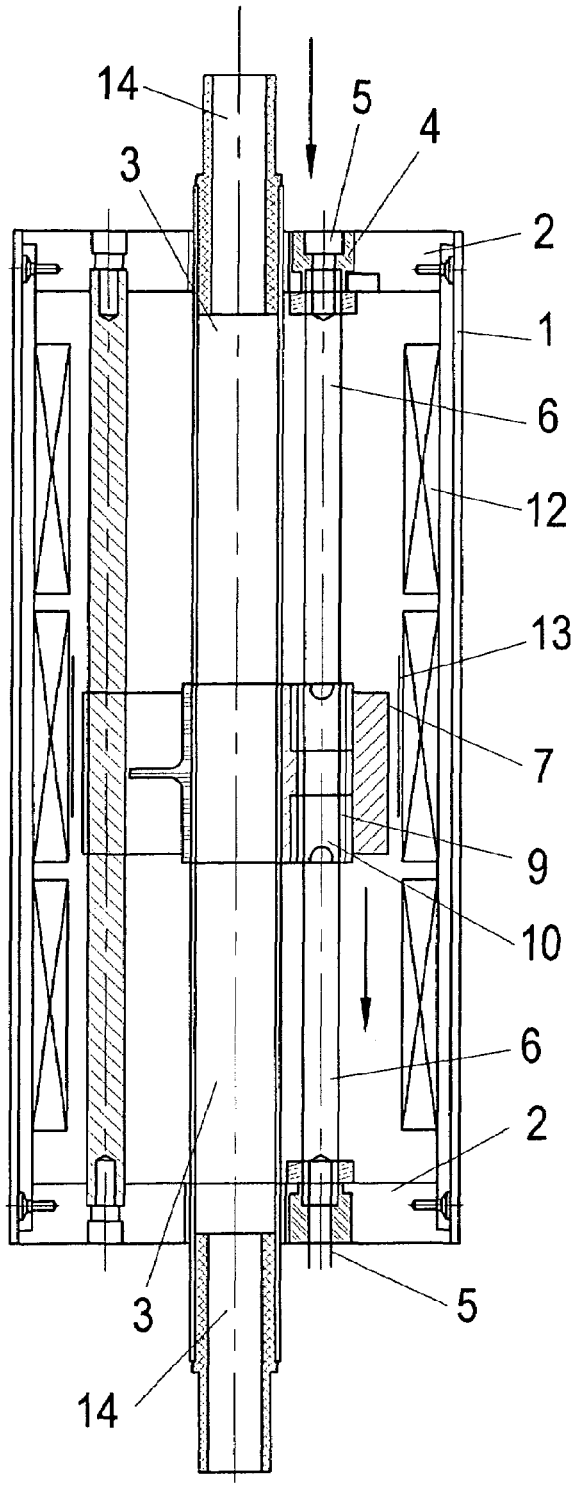
FIG. 4 illustrates the internal configuration of the massage device moving downward.

Referring to FIGS. 1, 2, 3 and 4, a massage device according to the present invention capable of producing vibrating or reciprocating motions for massaging muscles of a person comprises a cylindrical shell 1 enclosed at two ends by a pair of end plates 2, a central axle 3 coaxially extending along the shell 1 slightly out of both of the end plates 2, and a pair of conducting electric brush axles 6 parallel to the central axle 3 retained on the end plates 2 respectively by screw bolts 5 and insulating sleeves 4. Each of the ends of the central axle 3 is further provided with a connecting member 14, and the middle section of the central axle 3 is provided with a voice coil 7, which further includes a plurality of grooves 8 for respectively embedding electric brushes 9. Each of the electric brushes 9 is further provided with a brush insulating sleeve 10 for holding the electric brush axle 6. Two opposite sides of the voice coil 7 are respectively provided with magnetically permeable plates 11 of partial annular shape. Further, the upper, middle and lower sections of the inner wall of the shell 1 are each provided with a set of magnets 12 of partial annular shape arranged. Further, the magnets 12 are arranged in alternating N, S polarities in the longitudinal direction of the shell 1. Coils 13 respectively electrically connected to the electric brush axles 6 are located between the conducting magnetic plates 11 and the magnets 12.

Thereby, an electric current can be guided into the electric brush axles 6 and coils 13, producing a magnetic field interacting with the background magnetic fields of the magnets 12. Since the current is alternating, the periodically changing force in the longitudinal direction of the shell 1 can be achieved, whereby the central axle 3 will be driven up and down. Such a reciprocating motion will facilitates a massage effect based on this device. Since the central axle 3 is magnetically driven, there is no electric wire moving with the central axle 3, therefore producing no running down of wires, and therefore the massage device will be more durable.

As shown in FIGS. 1, 2, 3 and 4, the massage device of the present invention is a shell 1, enclosed at the upper and lower end by a pair of end plates 2, houses a coaxial central axle 3 provided with a middle voice coil 7 having a plurality of brushes 9. The brushes 9 are each slidably mounted on a longitudinal electric brush axle 6 through an insulting sleeve 10. The inner wall of the shell 1 is provided by upper, middle and lower sets of magnets 12, whereby an electric current flowing into the electric brush axles 6 and the coils 13 mounted thereon will produces a magnetic field interacting with the field by the magnets 12, urging the central axle 3 to move in the longitudinal direction. Since the current is alternating, the associated motion of central axle 3 is reciprocating.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A massage device, capable of producing vibrating or reciprocating motions for massaging muscles of a person, comprising:

a cylindrical shell enclosed at two ends there of by a pair of end plates, an inner wall of said shell being attached with upper, middle and lower sets of magnets of partial annular shape, said magnets being arranged in alternating N and S polarities along the axis of said shell;

a central axle coaxially extending along said shell and slightly out of both of said end plates, said central axle being further provided with connecting members at both end and a voice coil at a middle section, said voice coil further including a plurality of grooves for respectively embedding electric brushes, each of said electric brushes being further provided with a brush insulating sleeve for holding one of said electric brush axles, two opposite sides of said voice coil being respectively provided with magnetically permeable plates of partial annular shape; and a pair of conducting electric brush axles extending parallel to said central axle, said electric brush axles being retained on said end plates respectively by screw bolts and insulating sleeves;

whereby an electric current flowing into said electric brush axles and said coils mounted thereon will produces a magnetic field interacting with the magnetic field by the magnets, urging the central axle to move in the longitudinal direction, and whereby an alternating current will produce a corresponding reciprocating motion of said central axle, suitable for driving a massage head.

* * * * *